US009371735B2

(12) United States Patent
Reilly et al.

(10) Patent No.: US 9,371,735 B2
(45) Date of Patent: Jun. 21, 2016

(54) GAS TURBINE ENGINE TURBINE NOZZLE IMPINGEMENT COVER

(71) Applicant: Solar Turbines Incorporated, San Diego, CA (US)

(72) Inventors: William Landon Reilly, San Diego, CA (US); David Jeorling, Temecula, CA (US); Adrian Nazareno Reyes, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 804 days.

(21) Appl. No.: 13/689,250

(22) Filed: Nov. 29, 2012

(65) Prior Publication Data

US 2014/0147259 A1 May 29, 2014

(51) Int. Cl.
*F01D 5/18* (2006.01)
*F01D 9/04* (2006.01)

(52) U.S. Cl.
CPC ..... *F01D 9/041* (2013.01); *F01D 5/189* (2013.01); *F05D 2230/232* (2013.01)

(58) Field of Classification Search
CPC ..... F01D 9/02; F01D 9/041; F01D 9/042; F01D 9/06; F01D 9/062
USPC ..... 415/115, 116
See application file for complete search history.

(56) References Cited

U.S. PATENT DOCUMENTS

| | | | | |
|---|---|---|---|---|
| 6,343,911 | B1 * | 2/2002 | Burdgick | F01D 5/187 415/114 |
| 6,382,906 | B1 | 5/2002 | Brassfield et al. | |
| 6,422,810 | B1 | 7/2002 | Burdgick et al. | |
| 6,508,623 | B1 | 1/2003 | Shiozaki et al. | |
| 7,766,609 | B1 | 8/2010 | Liang | |
| 2005/0123388 | A1 | 6/2005 | Brian Chan et al. | |
| 2009/0067994 | A1 * | 3/2009 | Pietraszkiewicz | F01D 11/08 415/173.1 |
| 2009/0220331 | A1 * | 9/2009 | Shapiro | F01D 9/042 415/115 |
| 2010/0266386 | A1 | 10/2010 | Broomer et al. | |
| 2011/0229305 | A1 * | 9/2011 | Bergman | F01D 9/041 415/115 |
| 2012/0020768 | A1 | 1/2012 | Krueckels et al. | |
| 2012/0177478 | A1 * | 7/2012 | Giri | F01D 5/187 415/115 |

FOREIGN PATENT DOCUMENTS

| | | |
|---|---|---|
| CN | 1525049 | 9/2004 |
| CN | 102588013 | 7/2012 |
| WO | 2011026503 A1 | 3/2011 |

* cited by examiner

*Primary Examiner* — Nathaniel Wiehe
*Assistant Examiner* — Woody A Lee, Jr.
(74) *Attorney, Agent, or Firm* — Procopio, Cory, Hargreaves & Savitch LLP

(57) ABSTRACT

An impingement cover (460) for fusing to a gas turbine engine turbine nozzle (451) with a nozzle rail (455) includes a body and a plurality of tabs for forming a first fuse with the nozzle rail (455). The body has a plate like shape and includes a plurality of impingement holes (464), a first edge, a second edge, and a first airfoil cooling hole (470). The plurality of tabs includes a first tab (461) extending from the first edge, and a second tab (462) extending from the second edge. The second tab (462) is located in a different quadrant of the body than the first tab (461).

20 Claims, 4 Drawing Sheets

GAS TURBINE ENGINE TURBINE NOZZLE IMPINGEMENT COVER

TECHNICAL FIELD

The present disclosure generally pertains to gas turbine engines, and is more particularly directed toward a turbine nozzle impingement cover.

BACKGROUND

Gas turbine engines include compressor, combustor, and turbine sections. Portions of a gas turbine engine are subject to high temperatures. In particular, the first stages of the turbine section are subject to such high temperatures that these stages are often cooled with relatively cool air directed from the compressor.

International publication No. WO 2011/026503 to D. Butler discloses an invention related to a deflector for guiding a cooling fluid to a blade device of a turbine. The deflector comprises a first opening region with a first opening shape and a second opening region with a second opening shape. The deflector is connectable to a first blade device and to a second blade device in such a way that the cooling fluid is streamable through the first opening region into the first blade device and the cooling fluid is streamable through the second region into the second blade device. The first opening shape differs horn the second opening shape for achieving a predetermined first mass flow of the cooling fluid into the first blade device and a predetermined second mass flow of the cooling fluid into the second blade device at predetermined installation locations of the first blade device and the second blade device.

The present disclosure is directed toward overcoming one or more of the problems discovered by the inventors.

SUMMARY OF THE DISCLOSURE

An impingement cover for fusing to a gas turbine engine turbine nozzle with a nozzle rail is disclosed. The impingement cover includes a body and a plurality of tabs for forming a first fuse with the nozzle rail. The body has a plate like shape and includes a plurality of impingement holes, a first edge, a second edge, and an airfoil cooling hole. The plurality of tabs includes a first lab extending from the first edge, and a second tab extending from the second edge. The second tab is located in a different quadrant of the body than the first tab.

A method for joining an impingement cover to a gas turbine engine turbine nozzle is also disclosed. The method includes placing an impingement cover within a nozzle rail of the turbine nozzle. The impingement cover has a first tab extending from a first edge and a second tab extending from a second edge. The method also includes fusing the first tab and the second tab to the nozzle rail. The method further includes fusing the first edge and the second edge to the nozzle rail.

DETAILED DESCRIPTION

The systems and methods disclosed herein include a gas turbine engine turbine nozzle with an impingement cover. In embodiments, the gas turbine engine turbine nozzle includes a nozzle rail and the impingement cover includes multiple edges and multiple tabs. Each tab is fused to the nozzle rail and each edge is fused to the nozzle rail. The tabs may act as stand-offs, such that each edge is spaced apart from the turbine rail. Including a space between the edges of the impingement cover and the turbine rail while fusing them together may prevent areas of negative reinforcement in the joint, formation of a u-shaped joint, and may prevent cracks in the joint.

Figure 1:
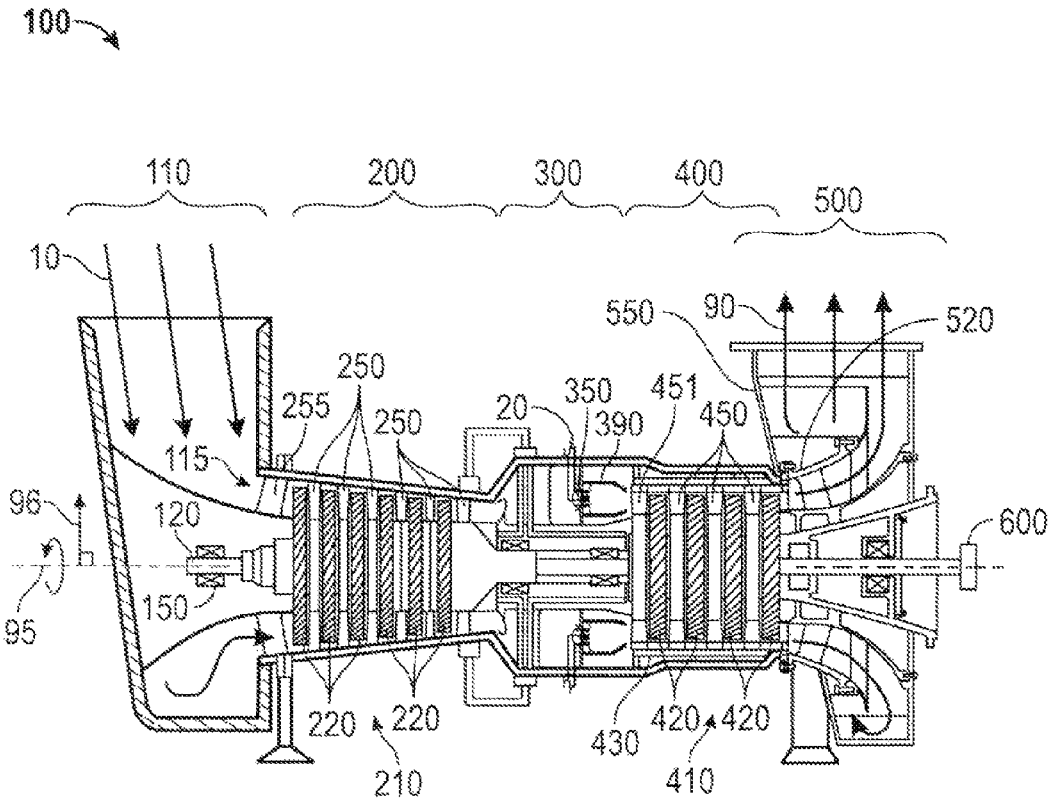
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a shaft 120, a gas producer or "compressor" 200, a combustor 300, a turbine 400, an exhaust 500, and a power output coupling 600. The gas turbine engine 100 may have a single shall or a dual shaft configuration.

The compressor 200 includes a compressor rotor assembly 210, compressor stationary vanes ("stators") 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the first compressor stage.

The combustor 300 includes one or more injectors 350 and includes one or more combustion chambers 390.

The turbine 400 includes a turbine rotor assembly 410, turbine nozzles 450, and turbine housing 430. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. Turbine nozzles 450 axially precede each of the turbine disk assemblies 420. Each turbine disk assembly 420 paired with the adjacent turbine nozzles 450 that precede the turbine disk assembly 420 is considered a turbine stage. Turbine 400 includes multiple turbine stages. The forward most turbine nozzles 450 may be considered the first stage turbine nozzles ("nozzles") 451. Turbine housing 430 is located radially outward from and adjacent to turbine nozzles 450. Turbine housing 430 may extend completely around the turbine rotor assembly 410 and turbine nozzles 450.

The exhaust 500 includes an exhaust diffuser 520 and an exhaust collector 550.

Figure 2:
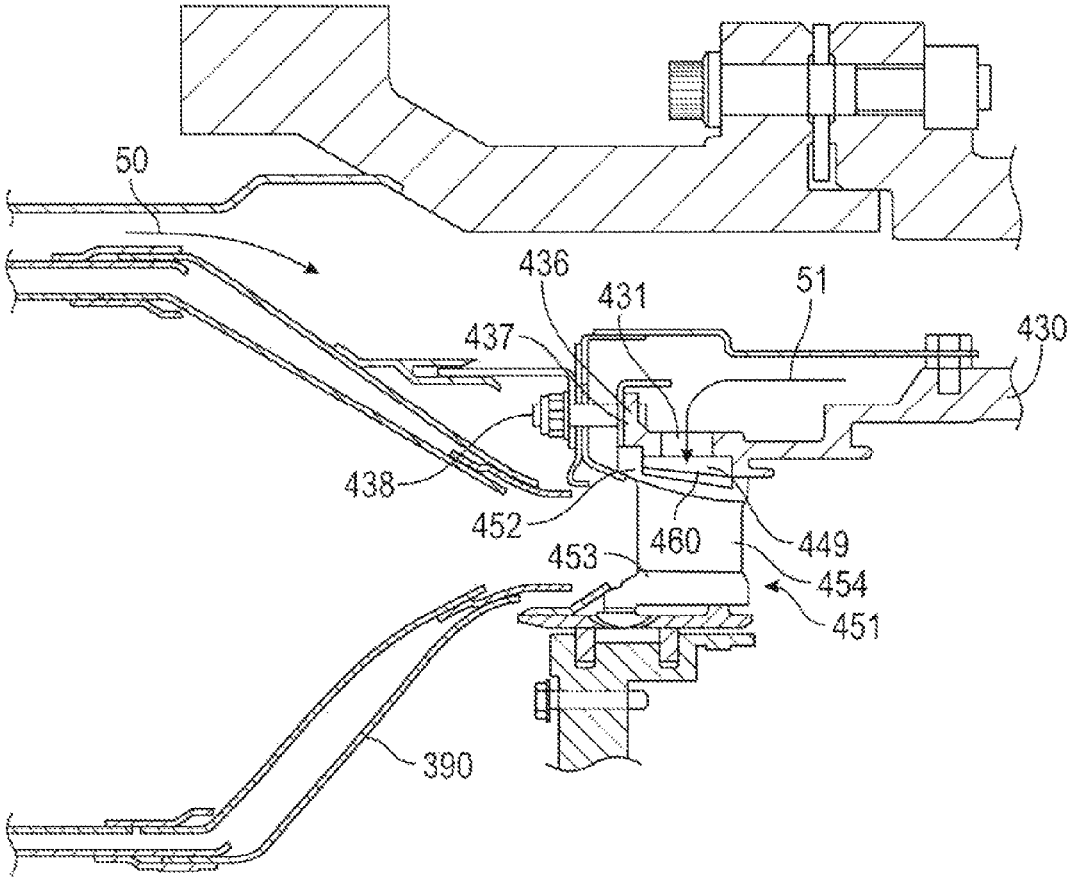
FIG. 2 is a cross-sectional view of a portion of a turbine of the gas turbine engine of FIG. 1.

FIG. 2 is a cross-sectional view of a portion of the turbine of the gas turbine engine of FIG. 1. Turbine housing 430 may have the general shape of a hollow cylinder. Turbine housing 430 may include cooling holes 431 (only one is shown in FIG. 2) distributed circumferentially about turbine housing 430. Cooling holes 431 extend radially through turbine housing 430.

Forward flange 436 may protrude radially outward from an axially forward end of turbine housing 430. Forward flange 436 may include mounting holes 437. Mounting holes 437 are circumferentially located about flange 436. Each mounting hole 437 axis may be parallel to the axis of turbine housing 430. A coupler 438, such as a bolt, may be inserted into each mounting hole 437 to secure the turbine housing 430 to the gas turbine engine.

Nozzles 451 are located radially inward from turbine housing 430 and axially aft of combustion chamber 300 (only one is shown in FIG. 2). Each nozzle 451 includes an outer wall 452, an inner wall 453, and one or more airfoils 454 extending between the two walls. Inner wall 453 is located radially inward from outer wall 452. Outer wall 452 and inner wall 453 are connected by one or more airfoils 454. Outer wall 452 is located radial adjacent to turbine housing 430. The first turbine stage may include multiple nozzles 451 circumferentially aligned forming a ring of nozzles.

Turbine housing 430 and outer wall 452 may be configured to define cavity 449 there between. Cooling holes 431 are in flow communication with cavity 449. In one embodiment, cavity 449 is defined by turbine housing 430 and the outer walls 452 of the ring of nozzles and circumferentially extends completely around the ring of nozzles.

Figure 3:
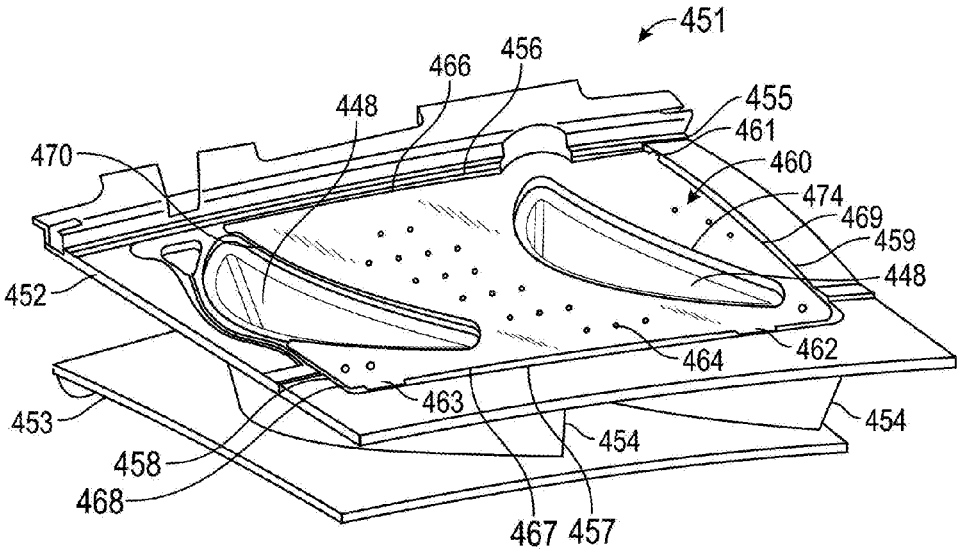
FIG. 3 is a perspective view of the turbine nozzle of FIG. 2 with an impingement cover.

An impingement cover 460 may be joined to each nozzle 451 and may be located within cavity 449. FIG. 3 is a perspective view of a nozzle 451 of FIG. 2 with an impingement cover 460. In the embodiment depicted in FIG. 3, each nozzle 451 includes a pair of airfoils 454 and related elements. Alternatively each nozzle may include any number of airfoils 454 such as a single airfoil 454 or three airfoils 454. Referring to FIG. 3, each outer wall 452 may include a nozzle rail 455 extending completely around the perimeter of outer wall 452. Nozzle rail 455 may include a forward rail 456, an aft rail 457, a leading rail 458, and a trailing rail 459. Forward rail 456 may be the axially forward rail of outer wall 452, adjacent to combustion chamber 390. Aft rail 457 may be the rail opposite forward rail 456, distal to combustion chamber 390. Leading rail 458 may be the rail extending between forward rail 456 and aft rail 457 proximal to the suction side of an airfoil 454. Trailing rail 459 may be the rail opposite leading rail 458 extending between forward rail 456 and aft rail 457 proximal to the pressure side of an airfoil 454. Each airfoil 454 may include a cooling air path 448 extending through airfoil 454.

Figure 4:
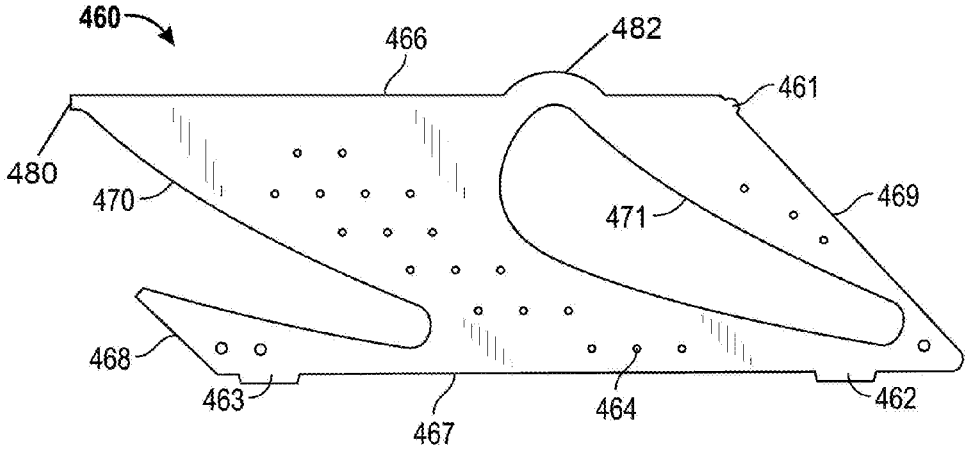
FIG. 4 is a plan view of the impingement cover of FIG. 3.

FIG. 4 is a plan view of the impingement cover 460 of FIG. 3. Referring to FIGS. 3 and 4, impingement cover 460 includes a plate like body with a plurality of impingement holes 464. Impingement holes 464 may be located in a preselected pattern. Impingement cover 460 may also include one or more airfoil cooling holes or cut-outs. The number of airfoil cooling holes may depend on the number of airfoils 454 provided in the corresponding nozzle 451. In the embodiment shown in FIGS. 3 and 4, impingement cover 460 includes first cooling hole 470 and second cooling hole 471. First cooling hole 470 and second cooling hole 471 may correspond to cooling air paths 448 for a leading airfoil and a trailing airfoil respectively.

Impingement cover 460 may include multiple edges. In some embodiments, impingement cover 460 includes a forward edge 466, an aft edge 467, a leading edge 468, and a trailing edge 469. Forward edge 466 may be the axially forward edge when impingement cover 460 is installed in gas turbine engine 100, proximal combustion chamber 390. Aft edge 467 may be the edge opposite forward edge 466, distal to combustion chamber 390. Leading edge 468 may be the edge extending between forward edge 466 and aft edge 467 adjacent to the side of an airfoil cooling hole corresponding to an airfoil 454 near leading rail 468. Trailing edge 469 may be the edge opposite leading edge 468 extending between forward edge 466 and aft edge 467 adjacent to the side of an airfoil cooling hole corresponding to the pressure side of an airfoil 454.

In the embodiment shown in FIG. 3, forward edge 466 is adjacent forward rail 456, aft edge 46 is adjacent aft rail 457, leading edge 468 is adjacent leading rail 468, and trailing edge 469 is adjacent trailing rail 468 when impingement cover is joined to nozzle 451. First airfoil cooling hole 470 is proximal leading edge 468 and second airfoil cooling hole 471 is proximal trailing edge 469.

Impingement cover 460 includes multiple tabs. The tabs may extend from two or more edges. The multiple tabs serve as contact points with nozzle rail 455 prior to joining impingement cover 460 to nozzle 451. The impingement cover 460 includes a first tab extending from a first edge and a second tab extending from a second edge. The first edge and the second edge may be the forward edge 466, the aft edge 467, the leading edge 468, or the trailing edge 469. Impingement cover 460 may also include a third tab. The third tab may extend from the second edge or may extend from a third edge. The third edge may be the forward edge 466, the aft edge 467, the leading edge 468, or the trailing edge 469. Tab 480 may extend from the leading edge 468, and tab 482 may extend from the forward edge 466.

Each tab may be remote from, spaced apart from, or distal to the other tabs. Impingement cover 460 may be divided into quadrants with each tab being located in a different quadrant. In one embodiment, each tab is located adjacent a different corner of impingement cover 460. In another embodiment, each tab is approximately located at the midpoint of different edges. In the embodiment shown in FIGS. 3 and 4, impingement cover 460 includes first tab 461, second tab 462, and third tab 463. First tab 461 extends from trailing edge 469, proximal forward edge 466. Second tab 462 extends from aft edge 467, proximal trailing edge 469. Third tab 463 extends from aft edge 467, proximal leading edge 468.

Each tab may be sized to provide a minimal amount of material to be fused to the nozzle rail 455 prior to joining each edge to the nozzle rail 455. In one embodiment, each tab is less than one-third of the length of the edge the tab extends from. In another embodiment, each tab is less than ten percent of the length of the edge the tab extends from.

A shape for each tab may be selected to minimize the contact between the tab and the nozzle rail. For example, tabs may be rounded, squared, circular, rectangular, and trapezoidal. Other shapes may also be used. In the embodiment shown in FIGS. 3 and 4, first tab 461 is circular, second tab 462 is trapezoidal, and third tab is trapezoidal.

Prior to joining impingement cover 460 to nozzle 451, each tab may contact nozzle rail 455, while each edge may not contact nozzle rail 455. Nozzle 451 may also include a land or a ledge (not shown in the FIGS.). Each tab may also contact the land or the ledge to support the impingement cover 460 prior to being joined to nozzle rail 455. In the embodiment shown in FIG. 3, first tab 461 may contact trailing rail 459 and the land, second tab 462 may contact aft rail 457 and the land, and third tab may contact aft rail 457 and the land. Forward, edge 466 may not contact forward rail 456, aft edge 467 may not contact aft rail 457, leading edge 468 may not contact 458, and trailing edge 469 may not contact trailing rail 459. Each tab may be joined or fused to the nozzle rail 455 by a first weld. Each edge may be joined or fused to the nozzle rail 455 by a second weld. The first weld may be a tack weld and the second weld may be a laser weld.

The tabs may be situated such that the space between the edges of the impingement cover edges and nozzle rail 455 has a minimum clearance of 0.020" (0.508 mm). In one embodiment, the space between the impingement cover edges and nozzle rail 455 is from 0.020" (0.508 mm) to 0.40" (1.016 mm). In another embodiment the space between the impingement cover edges and nozzle rail 455 is approximately 0.030" (0.762 mm).

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel 20 is added. Air 10 and fuel 20 are injected into the combustion chamber 390 via injector 350 and combusted. Energy is extracted from the combustion reaction via the turbine 400 by each stage of the series of turbine disk assemblies 420. Exhaust gas 90 may then be diffused in exhaust diffuser 520, collected and redirected. Exhaust gas 90 exits the system via an exhaust collector 550 and may be further processed (e.g., to reduce harmful emissions, and/or to recover heat from the exhaust gas 90).

As shown in FIG. 2, an inlet cooling air flow 50 flows in a passage inside the turbine 400. Nozzle cooling air flow 51 passes through turbine housing 430. Nozzle cooling air flow 51 travels through cooling holes 431 and into cavity 449. The cooling air may then pass through the impingement cover 460 airfoil cooling holes into passage 455 to cool airfoils 454 and pass through impingement holes 464 to cool outer wall 452 with impingement airflow.

An impingement cover may be joined, united, or fused to a nozzle by welding, brazing, or a similar process. Prior to joining an impingement cover to a nozzle there may be minimal clearances between the edges of the impingement cover and the nozzle rail. The minimal clearances may prevent the impingement cover from shifting during the joining process. However, overlapping tolerances of the minimal clearances may lead to interference between the edges and the rails. Each edge may have to be grinded down to fit within the rails prior to the joining process, which may lead to an increase in manufacturing costs.

During the joining process, the impingement cover and the nozzle rail may thermally expand. This thermal expansion combined with a minimal clearance prior to the joining process may lead to areas of negative reinforcement or a u-shaped joint, which may cause cracks in the joint.

Impingement cover 460 includes multiple tabs that may act as stand-offs, allowing for a space for the joint to be created between the edges or outer perimeter of impingement cover 460 and nozzle rail 455. The tabs may contact nozzle rail 455 and may stabilize impingement cover 460 within nozzle 451 prior to the joining process. Without tabs, separate tooling may be necessary to stabilize an impingement cover within a nozzle prior to the joining process.

Figure 5:
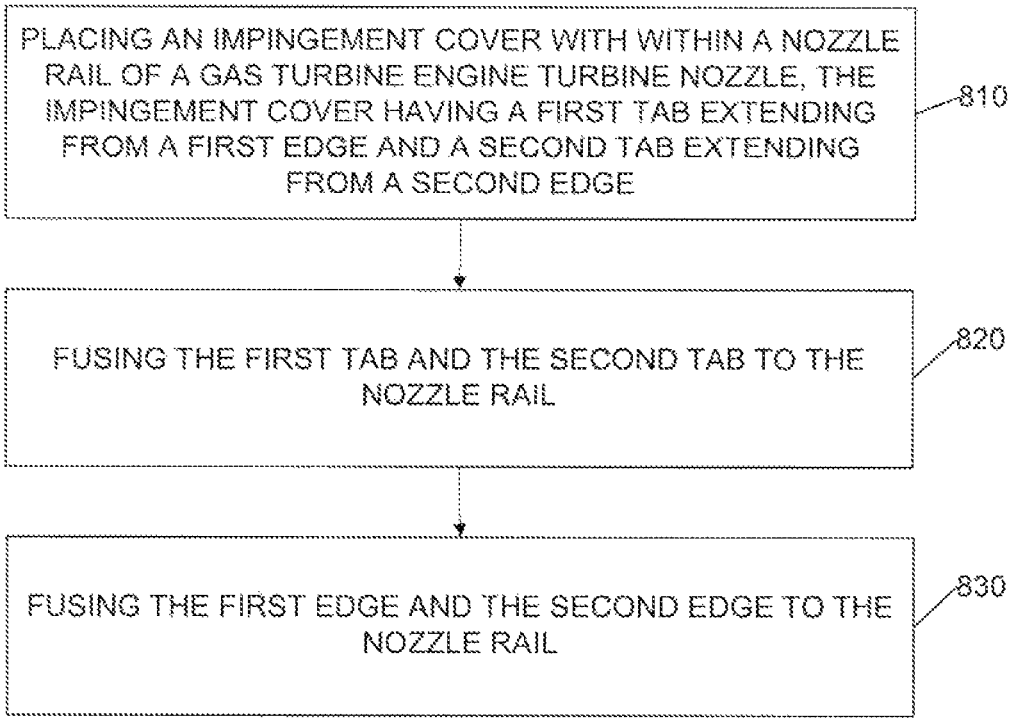
FIG. 5 is a flowchart of a method for joining an impingement cover to a turbine nozzle.

FIG. 5 is a flowchart of a method for joining an impingement cover to a turbine nozzle. The method includes placing an impingement cover within a nozzle rail of a gas turbine engine; the impingement cover includes a first tab extending from a first edge and a second tab extending from a second edge at step 810. In one embodiment, impingement cover 460 shown in FIGS. 3 and 4 is used. The tabs may ensure stability of the impingement cover within the turbine nozzle rail during the joining process. Tabs may need to be grinded to ensure the impingement cover fits within the nozzle rail.

Step 810 is followed by fusing the first tab and the second tab to the nozzle rail at step 820. Step 820 may include fusing more tabs to the nozzle rail. Each tab may be fused to the nozzle rail by a first welding process, such as tack welding. In an embodiment using impingement cover 460 shown in FIGS. 3 and 4, first tab 461 is tack welded to trailing rail 457, and second tab 462 and third tab 463 are tack welded to aft rail 457. Step 820 is followed by fusing the first edge and the second edge to the nozzle rail at step 830. Step 830 may include fusing more edges to the nozzle rail. Each edge may be joined to the nozzle rail by a second welding process, such as laser welding. In the embodiment using impingement cover 460 shown in FIGS. 3 and 4, forward edge 466 is laser welded to forward rail 456, aft edge 467 is laser welded to aft rail 457, leading edge 468 is laser welded to leading rail 458, and trailing edge 469 is laser welded to trailing rail 459. Other welding processes such as spot welding and resistance welding may also be used at steps 820 and 830.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes a particular impingement cover for joining to a particular first stage turbine nozzle, it will be appreciated that the impingement cover in accordance with this disclosure can be implemented in various other configurations, can be used with various other types of turbine nozzles, including turbine nozzles from various other stages, and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. An impingement cover for fusing to a gas turbine engine turbine nozzle with a nozzle rail, the impingement cover comprising:

a body with a plate-like shape divisible into quadrants and having a first edge and a second edge, the body defining a plurality of impingement holes and a first airfoil cooling hole; and a plurality of tabs for forming a first fuse with the nozzle rail, the plurality of tabs including a first tab extending from the first edge, and a second tab extending from the second edge, the second tab being located in a quadrant of the body that is different from a quadrant of the first tab, a length of the first tab is less than one-third of a length of the first edge, and a length of the second tab is less than one-third of a length of the second edge.

2. The impingement cover of claim 1, wherein the body has a third edge, and the plurality of tabs includes a third tab extending from the third edge.

3. The impingement cover of claim 1, wherein the plurality of tabs includes a third tab extending from the second edge.

4. The impingement cover of claim 3, wherein the first edge is a trailing edge, located proximal to a pressure side of the first airfoil cooling hole, and the second edge is an aft edge located adjacent to the trailing edge.

5. The impingement cover of claim 4, wherein the body further includes a forward edge disposed opposite the second edge and adjacent to the first edge, and a leading edge located opposite the first edge, and wherein the first tab extends from the first edge proximal to the forward edge, the second tab extends from the second edge proximal to the first edge, and the third tab extends from the second edge proximal to the leading edge.

6. The impingement cover of claim 4, wherein the first tab is circular in shape, the second tab is trapezoidal in shape, and the third tab is trapezoidal in shape.

7. The impingement cover of claim 1, wherein the first edge is adjacent to the second edge.

8. The impingement cover of claim 1, wherein the length of the first tab is less than ten percent of the length of the first edge, and the length of the second tab is less than ten percent of the length of the second edge.

9. A turbine nozzle for a gas turbine engine, the turbine nozzle comprising:

an outer wall having a nozzle rail including a forward rail, an aft rail opposite the forward rail, a leading rail extending between the forward rail and the aft rail, and a trailing rail extending between the forward rail and the aft rail, and disposed opposite the leading rail;

an inner wall;

an airfoil extending between the outer wall and the inner wall, an interior of the airfoil defining a cooling air path therein; and an impingement cover having a plurality of edges including a forward edge adjacent to the forward rail, an aft edge adjacent to the aft rail, a leading edge adjacent to the leading rail and proximal to a suction side of the airfoil, and a trailing edge adjacent to the trailing rail, a first tab extending from a first edge of the plurality of edges and fused to the nozzle rail, and a second tab extending from a second edge of the plurality of edges and fused to the nozzle rail, the second tab being located in a quadrant of the impingement cover that is different from a quadrant of the first tab, the impingement cover defines a plurality of impingement holes adjacent to the outer wall, and defines a first airfoil cooling hole aligned with the cooling air path, a length of the first tab is less than one-third of a length of the first edge, and a length of the second tab is less than one-third of a length of the second edge.

10. The turbine nozzle of claim 9, wherein the first tab and the second tab are fused to the nozzle rail with a first weld and each edge of the plurality of edges is fused to the nozzle rail with a second weld.

11. The turbine nozzle of claim 10, wherein the first weld is a tack weld and the second weld is a laser weld.

12. The turbine nozzle of claim 9, wherein the plurality of tabs includes a third tab extending from one edge of the plurality of edges.

13. The turbine nozzle of claim 12, wherein the first tab extends from the trailing edge proximal to the forward edge, the second tab extends from the aft edge proximal to the trailing edge, and the third tab extends from the aft edge proximal to the leading edge.

14. The turbine nozzle of claim 13, wherein the first tab is tack welded to the trailing rail, the second tab is tack welded to the aft rail, and the third tab is tack welded to the aft rail.

15. The turbine nozzle of claim 14, wherein the forward edge is laser welded to the forward rail, the aft edge is laser welded to the aft rail, the leading edge is laser welded to the leading rail, and the trailing edge is laser welded to the trailing rail.

16. The turbine nozzle of claim 15, wherein each edge of the impingement cover is spaced apart from the nozzle rail from 0.020" to 0.040".

17. The turbine nozzle of claim 9, wherein the length of the first tab and the length of the second tab are each less than ten percent of a length of one edge of the plurality of edges.

18. A gas turbine engine including a plurality of the turbine nozzles of claim 9, wherein the plurality of turbine nozzles form a turbine nozzle stage.

19. A method for joining an impingement cover to a gas turbine engine turbine nozzle, the method comprising:

placing an impingement cover within a nozzle rail of the turbine nozzle, the impingement cover having a first tab extending from a first edge and a second tab extending from a second edge;

fusing the first tab and the second tab to the nozzle rail; and fusing the first edge and the second edge to the nozzle rail, a length of the first tab being less than one-third of a length of the first edge, and a length of the second tab being less than one-third of a length of the second edge.

20. The method of claim 19, wherein the fusing the first tab and the second tab to the nozzle rail includes welding the first tab and the second tab to the nozzle rail, and wherein the fusing the first edge and the second edge to the nozzle rail includes welding the first edge and the second edge to the nozzle rail.

* * * * *